US007248810B2

(12) United States Patent
Miyabe et al.

(10) Patent No.: US 7,248,810 B2
(45) Date of Patent: Jul. 24, 2007

(54) CARTRIDGE, PROCESS CARTRIDGE, AND ELECTROPHOTOGRAPHIC IMAGE FORMING APPARATUS

(75) Inventors: Shigeo Miyabe, Numazu (JP); Shinjiro Toba, Mishima (JP); Takahito Ueno, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 288 days.

(21) Appl. No.: 10/960,055

(22) Filed: Oct. 8, 2004

(65) Prior Publication Data

US 2006/0067725 A1 Mar. 30, 2006

(30) Foreign Application Priority Data

Sep. 27, 2004 (JP) ..... 2004/279247

(51) Int. Cl.
*G03G 15/00* (2006.01)

(52) U.S. Cl. ..... 399/90; 399/111

(58) Field of Classification Search ..... 399/88, 399/90, 110, 111
See application file for complete search history.

(56) References Cited

U.S. PATENT DOCUMENTS

| | | | | |
|---|---|---|---|---|
| 5,331,373 | A | 7/1994 | Nomura et al. | 355/200 |
| 5,452,056 | A | 9/1995 | Nomura et al. | 355/200 |
| 5,585,889 | A | 12/1996 | Shishido et al. | 355/200 |
| 5,839,028 | A | 11/1998 | Nomura et al. | 399/109 |
| 5,873,012 | A | 2/1999 | Miyabe et al. | 399/90 |
| 5,878,309 | A | 3/1999 | Nomura et al. | 399/111 |
| 5,878,310 | A | 3/1999 | Noda et al. | 399/117 |
| 5,926,666 | A | 7/1999 | Miura et al. | 399/25 |
| 5,943,529 | A | 8/1999 | Miyabe et al. | 399/111 |
| 5,946,531 | A | 8/1999 | Miura et al. | 399/111 |
| 5,950,047 | A | 9/1999 | Miyabe et al. | 399/111 |
| 5,966,567 | A | 10/1999 | Matsuzaki et al. | 399/111 |
| 6,011,941 | A * | 1/2000 | Takashima et al. | 399/111 |
| 6,029,031 | A | 2/2000 | Yokomori et al. | 399/109 |
| 6,064,843 | A | 5/2000 | Isobe et al. | 399/111 |
| 6,072,968 | A | 6/2000 | Nomura et al. | 399/113 |
| 6,128,452 | A | 10/2000 | Miyabe et al. | 399/90 |
| 6,144,398 | A * | 11/2000 | Yokoyama et al. | 347/263 |
| 6,154,623 | A | 11/2000 | Suzuki et al. | 399/111 |
| 6,167,219 | A | 12/2000 | Miyamoto et al. | 399/90 |
| 6,173,140 | B1 | 1/2001 | Suzuki et al. | 399/113 |
| 6,215,969 | B1 | 4/2001 | Nomura et al. | 399/111 |
| 6,282,390 | B1 | 8/2001 | Miyabe et al. | 399/111 |

(Continued)

FOREIGN PATENT DOCUMENTS

| | | |
|---|---|---|
| JP | 2000-4371 | 1/2000 |
| JP | 2004-004371 A | 1/2004 |

*Primary Examiner*—Robert Beatty
(74) *Attorney, Agent, or Firm*—Fitzpatrick, Cella, Harper & Scinto

(57) ABSTRACT

A cartridge detachably mountable to a mounting portion in a main assembly of an electrophotographic image forming apparatus, includes: a cartridge electrical contact supplying electric power to a process device and being electrically connectable to a main assembly electrical contact when the cartridge is mounted to the mounting portion; first and second portions to be guided by a main assembly guide to guide the cartridge to the mounting portion when the cartridge is mounted to the mounting portion; and a guide portion guiding the main assembly electrical contact to the cartridge electrical contact when the cartridge is mounted to the mounting portion. The guide portion is disposed between the first and second portions to be guided, and the cartridge electrical contact is upstream of the guide portion with respect to a direction in which the cartridge is mounted to the mounting portion.

22 Claims, 11 Drawing Sheets

U.S. PATENT DOCUMENTS 6,317,572 B1 11/2001 Miyabe et al. ..... 399/111
6,336,017 B1 1/2002 Miyamoto et al. ..... 399/116
6,343,192 B1 * 1/2002 Miyabe et al. ..... 399/13
6,351,620 B1 2/2002 Miyabe et al. ..... 399/111
6,424,811 B1 7/2002 Tsuda et al. ..... 399/167
6,519,431 B1 2/2003 Toba et al. ..... 399/111
6,542,633 B1 4/2003 Kori ..... 382/167
6,542,706 B2 4/2003 Toba et al. ..... 399/111
6,549,736 B2 4/2003 Miyabe et al. ..... 399/111
6,603,939 B1 8/2003 Toba et al. ..... 399/103
6,608,980 B2 8/2003 Murayama et al. ..... 399/111
6,714,752 B2 3/2004 Ueno et al. ..... 399/117
6,782,219 B2 8/2004 Yoshino et al. ..... 399/90
6,795,666 B2 9/2004 Miyabe et al. ..... 399/109
6,829,455 B2 12/2004 Yasumoto et al. ..... 399/167
6,993,264 B2 * 1/2006 Oguma et al. ..... 399/90
7,062,192 B2 * 6/2006 Oguma et al. ..... 399/90
7,079,783 B2 * 7/2006 Yokoi ..... 399/90
7,085,516 B2 * 8/2006 Kawai et al. ..... 399/111
2002/0085854 A1 7/2002 Numagami et al. ..... 399/90
2002/0159787 A1 10/2002 Chadani et al. ..... 399/109
2002/0191981 A1 12/2002 Miyabe et al. ..... 399/90
2005/0047823 A1 * 3/2005 Nakashima et al. ..... 399/111

* cited by examiner (a)

(b)

(a)

(b)

(a)

(b)

(a)

(b)

CARTRIDGE, PROCESS CARTRIDGE, AND ELECTROPHOTOGRAPHIC IMAGE FORMING APPARATUS

FIELD OF THE INVENTION AND RELATED ART

The present invention relates to a cartridge, a process cartridge, and an electrophotographic image forming apparatus.

Here, an electrophotographic image forming apparatus (which hereinafter may be referred to simply as image forming apparatus) is an apparatus for forming an image on a recording medium (for example, paper, an OHP sheet, etc.) with the use of an electrophotographic image forming apparatus. As for the examples of an image forming apparatus, an electrophotographic copying machine, an electrophotographic printer (for example, a laser beam printer, an LED printer, etc.), a facsimile machine, a word processor, etc., are included.

In the field of an electrophotographic image forming apparatus, there has long been known a cartridge in which one or more processing means, which act on an electrophotographic photosensitive member, are integrally placed, and also known has been a cartridge system which makes it possible to removably mount the cartridge into the main assembly of an image forming apparatus. As for the processing means, there are a charging means, a cleaning means, etc., in addition to a developing means. Thus, a charging cartridge having a charging means, a cleaning cartridge having a cleaning means, etc., are available in addition to a developing cartridge having a developing means.

Further, such a process cartridge system employing a cartridge (process cartridge) in which an electrophotographic photosensitive member, and one or more processing means are integrally placed, and which is removably mountable in the main assembly of an image forming apparatus, has also been employed.

A cartridge system such as the one described above makes it possible for a user to maintain an image forming apparatus by himself, that is, without relying on a service person, making it therefore possible to drastically improve the apparatus in operational efficiency. Therefore, a cartridge system has been widely used in the field of an image forming apparatus.

However, some of the processing means in a process cartridge need to be supplied with electric power from the main assembly of an image forming apparatus. Therefore, such cartridges are provided with electrical contacts for supplying them with electric power from the main assembly. For example, these electrical contacts are attached to the guiding members for guiding a process cartridge when mounting the cartridge into the main assembly (Japanese Laid-open Patent Application 2004-4371). Even this kind of structural arrangement can satisfactorily establish and maintain electrical contact between the electrical contact points of the cartridge and those on the main assembly side.

In the case of the above described structural arrangement, however, the area(s) of the cartridge, which are allocated for the electrical contacts are substantially larger than that (those) on the apparatus main assembly side. This is for ensuring that the electrical contacts on both sides come into contact with each other, and remain in contact.

SUMMARY OF THE INVENTION

Thus, the primary object of the present invention is to provide a combination of a cartridge, a process cartridge, and an electrophotographic image forming apparatus, which is substantially superior to that in accordance with the prior art, in terms of the level of reliability at which the electrical contacts on the cartridge side are connected, and remain connected, to their counterparts on the main assembly side of the image forming apparatus.

Another object of the present invention is to provide a combination of a cartridge, a process cartridge, and an electrophotographic image forming apparatus, which ensures that the electrical contacts of the cartridge are electrically connected to the electrical contacts on the apparatus main assembly side.

Another object of the present invention is to provide a combination of a cartridge, a process cartridge, and an electrophotographic image forming apparatus, which is substantially smaller in the areas of the electrical contacts of the cartridge, exposed from the cartridge frame, than that in accordance with the prior art.

Another object of the present invention is to place the electrical contacts of a process cartridge, between the first and second portions of one of the guides on the cartridge side, by which the cartridge is guided when the cartridge is mounted into the main assembly of an electrophotographic image forming apparatus, in order to ensure that even if the process cartridge wanders in a direction perpendicular to the direction in which the cartridge is mounted into the main assembly of the electrophotographic image forming apparatus when the cartridge is mounted into the main assembly, the electrical contacts on the cartridge side are reliably guided to the electrical contacts on the main assembly side.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

[Embodiment 1]

Hereinafter, the full-color image forming apparatus in the first embodiment of the present invention will be described with reference to the appended drawings.

[General Structure of Full-color Image Forming Apparatus]

Figure 1:
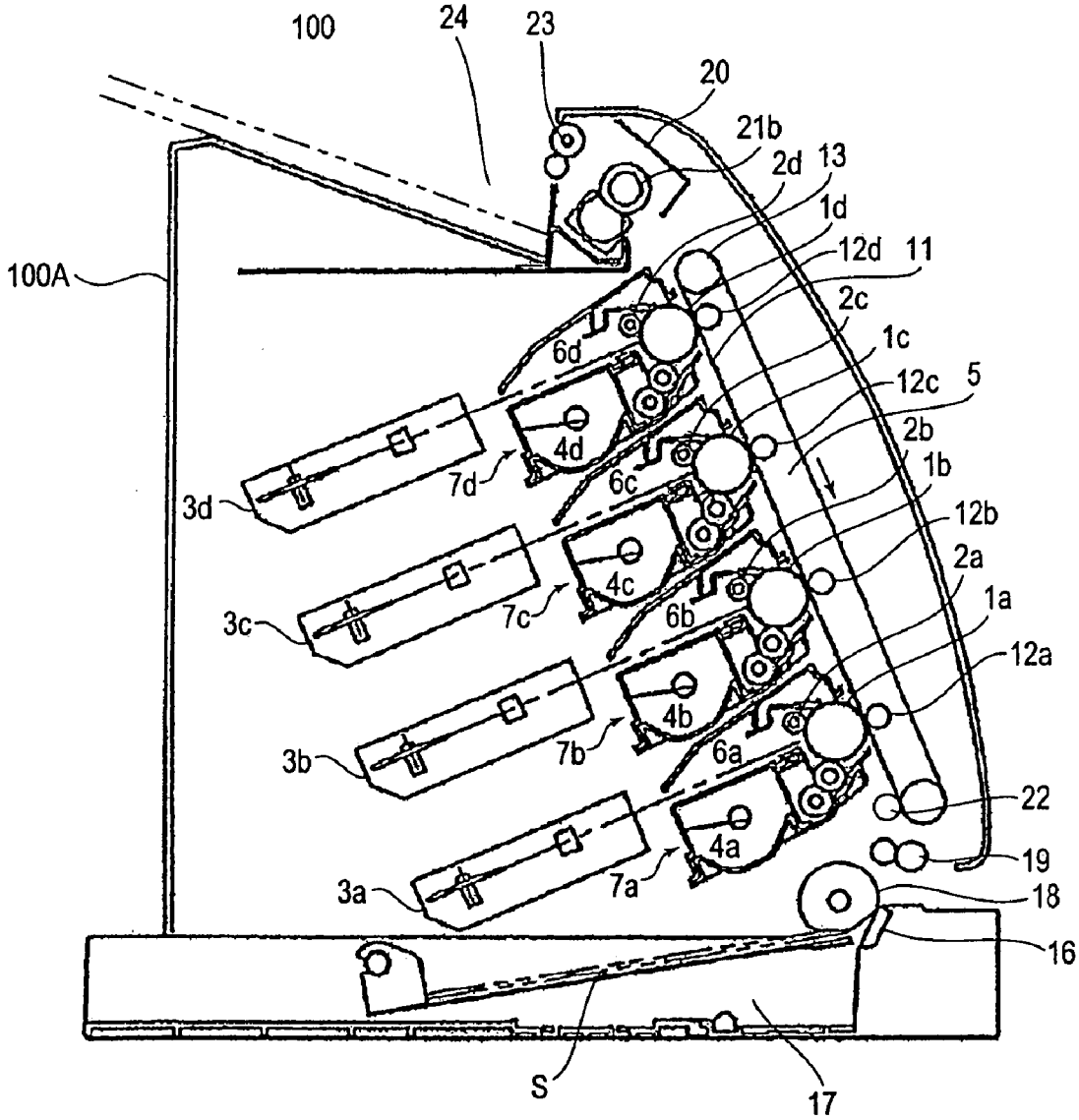
FIG. 1 is a sectional view of the full-color image forming apparatus in accordance with the present invention.

First, referring to FIG. 1, the general structure of the full-color image forming apparatus will be described. FIG. 1 is a sectional view of the electrophotographic full-color image forming apparatus, which is one form of a full-color image forming apparatus, showing the general structure thereof.

The electrophotographic full-color image forming apparatus 100 is provided with four electrophotographic photosensitive members, that is, photosensitive drum 1 (1*a*, 1*b*, 1*c*, and 1*d*) vertically stacked in parallel. Each photosensitive drum 1 is rotationally driven in the clockwise direction (FIG. 2) by a driving means (unshown). To list the components placed in the adjacencies of the peripheral surface of the photosensitive drum 1, from the first one, in the order in which they are used for image formation, in terms of the rotational direction of the photosensitive drum 1, the first one is a charge roller 2 (2*a*, 2*b*, 2*c*, and 2*d*) as a charging means for uniformly charging the peripheral surface of the photosensitive drum 1. The next one is a scanner unit 3*a*, 3*b*, 3*c*, and 3*d* for forming an electrostatic latent image on the peripheral surface of the photosensitive drum 1 by projecting a beam of laser light onto the peripheral surface of the photosensitive drum 1 while modulating it with image formation data. Next is a development unit 4(4*a*, 4*b*, 4*c*, and 4*d*) having a development roller 40 as a developing member for developing the electrostatic latent image. Next is a transferring apparatus 5 for transferring onto a recording medium S the development image formed on the peripheral surface of the photosensitive drum 1. The last one is a cleaning apparatus 6*a*, 6*b*, 6*c*, and 6*d* as a cleaning means for removing the residual developer, that is, the developer remaining on the peripheral surface of the photosensitive drum 1 after the transfer.

The photosensitive drum 1, the charge roller 2, the development unit 4, and the cleaning apparatus 6 are integrated in the form of a process cartridge 7 (7*a*, 7*b*, 7*c*, and 7*d*).

The transferring apparatus 5 is provided with a transfer belt 11 which is circularly moved. It is positioned in a manner to oppose all the photosensitive drums 1, and is kept in contact with them. Further, there are four transfer rollers 12*a*, 12*b*, 12*c*, and 12*d*, which are placed in parallel, in four positions, one for one, in which they oppose the four photosensitive drums 1, one for one, and contact the inward surface of the transfer belt 11, in terms of the loop which the transfer belt 11 forms.

A sheet conveying portion 16 conveys the recording medium S to the image forming station (cartridge 7). It is provided with a cassette 17, in which the recording media S are stored. During an image forming operation, a feed roller 18 (semicylindrical roller), and a pair of registration rollers 19 are rotationally driven in synchronism with the progression of the image forming operation, taking the recording media 2, one by one, out of the cassette 17, and conveying them, one by one, to the image forming station.

A fixing station 20 is a station for fixing the multiple developer images different in color, having been transferred onto the recording medium S, to the recording medium S. The fixing station 20 has a heat roller, which is rotatable, and a pressure roller 21*b*, which is kept pressed upon the heat roller in order to apply heat and pressure to the recording medium S.

The following is the description of the image forming operation carried out by this image forming apparatus. First, each of the photosensitive drums 1 is rotationally driven (in the counterclockwise direction), while the charge roller 2 uniformly charges the peripheral surface of the photosensitive drum 1. The scanners are sequentially driven in accordance with the image formation sequence, exposing the peripheral surfaces of the corresponding photosensitive drums 1 in response to the video signals. As a result, an electrostatic latent image is formed on the peripheral surface of each photosensitive drum 1. The development roller 40 of the development unit 4 transfers developer onto the numerous points of the electrostatic latent image, which are lower in potential level. As a result, a visible image is formed of the developer, on the peripheral surface of the photosensitive drum 1; the electrostatic latent image is developed (hereinafter, the image formed of developer will be referred to as developer image). Meanwhile, the recording medium S is fed into the apparatus main assembly by the feed roller 18 of the recording medium conveying portion 16, and is conveyed to the transfer belt 11 by the pair of registration rollers 19 of the conveying portion 16 so that a theoretical line on the recording medium S, at which the transfer of the developer image is to begin, and the leading edge of the developer image formed on peripheral surface of each photosensitive drum 1 align.

The recording medium S is conveyed by the transfer belt 11 through the nip between an adhesion roller 22 and transfer belt 11, being pinched by the adhesion roller 22 and transfer belt 11, and therefore, being pressed on the outward surface of the transfer belt 11. Further, while the recording medium S is conveyed through the nip, voltage is applied between the transfer belt 11 and adhesion roller 22. As a result, the electric charge is induced between the recording medium S, which is dielectric, and the dielectric layer of the transfer belt 11, causing the recording medium S to be electrostatically adhered to the outward surface of the transfer belt 11. Then, the recording medium S adhered to the transfer belt 11 is conveyed further by the transfer belt 11 through the four transfer stations.

While the recording medium S is conveyed through the four transfer stations, the developer images on the photosensitive drums 1 are sequentially transferred onto the recording medium S by the electric field formed by the photosensitive drum 1 and transfer roller, in each transfer station.

After the transfer of the four developer images different in color onto the recording medium S, the recording medium S is separated from the transfer belt 11 by the curvature of the belt driving roller 13. Then, the recording medium S is conveyed into the fixing station 20, in which the development images on the recording medium S are thermally fixed to the recording medium S. Thereafter, the recording medium S is discharged from the apparatus main assembly 100A, through the recording medium outlet 24, by a pair of discharge rollers 23.

[Structure of Process Cartridge]

Figure 2:
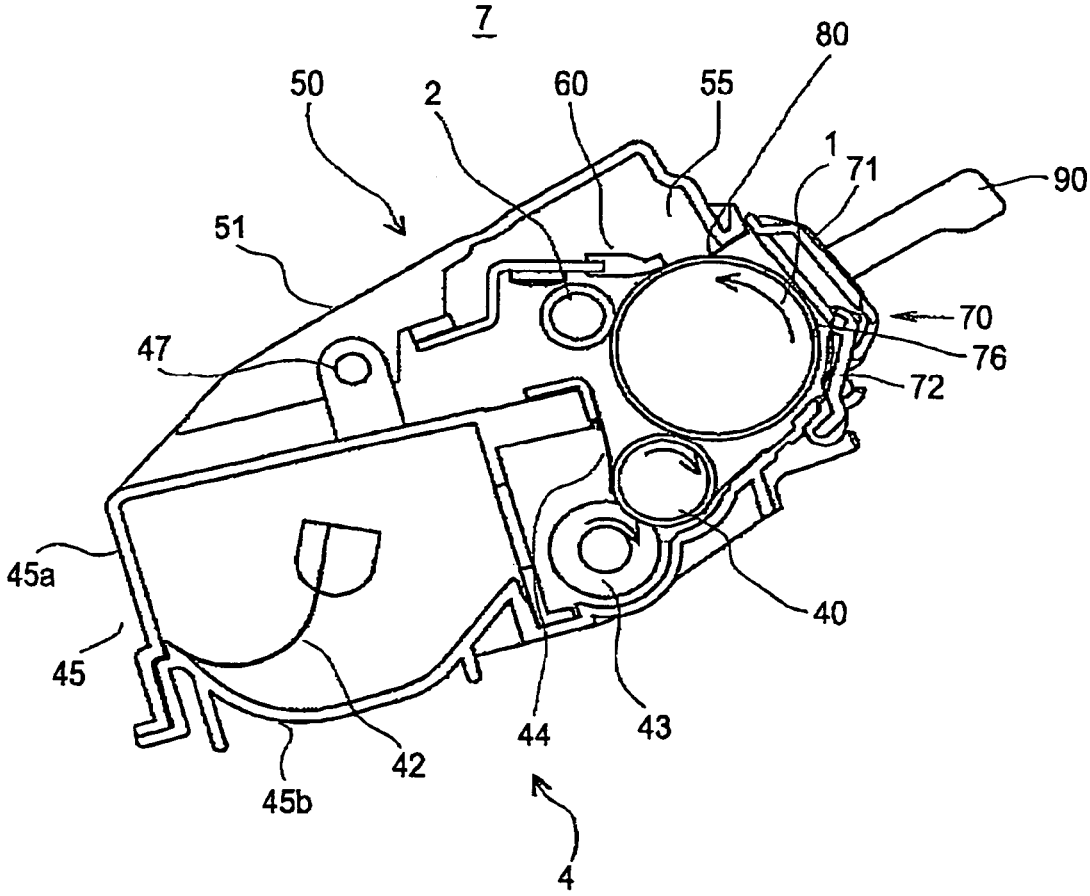
FIG. 2 is a sectional view of the process cartridge in accordance with the present invention.
Figure 3:
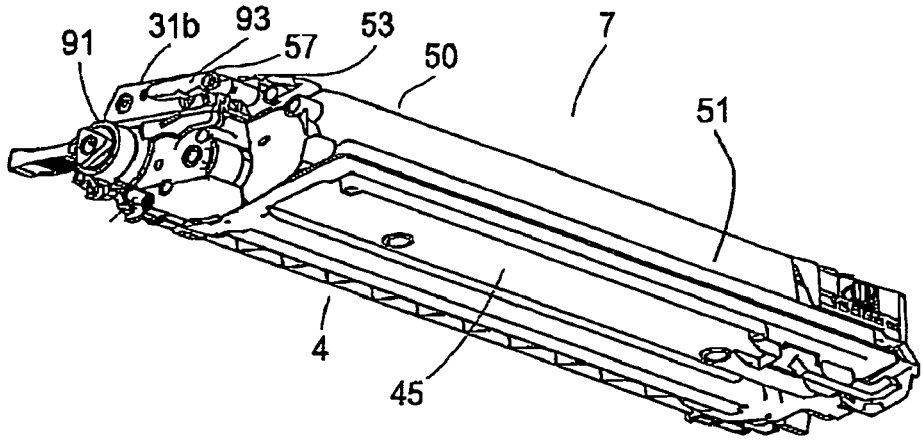
FIGS. 3(*a*) and 3(*b*) are perspective views of the process cartridge in accordance with the present invention.
Figure 3:
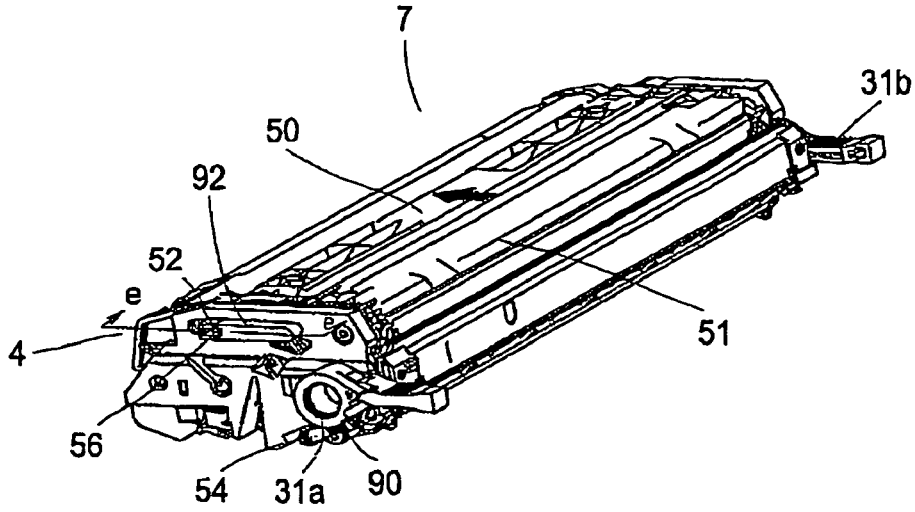

Next, referring to FIGS. 2 and 3, the process cartridge 7 in the first embodiment of the present invention will be described. FIG. 2 is a sectional view of the cartridge 7, in which developer is stored. FIGS. 3(*a*) and 3(*b*) are perspective views of the cartridge 7. The four cartridges 7 containing yellow, magenta, cyan, and black developers, one for one, are identical in structure.

Each cartridge 7 comprises the photosensitive drum 1, cleaner unit 50, and development unit 4. The cleaner unit 50 comprises the charge roller 2, and a cleaning blade 60 as a cleaning means.

The photosensitive drum 1 is made up of a substrate, for example, an aluminum cylinder, and a photosensitive layer provided on the peripheral surface of the aluminum cylinder. The photosensitive drum 1 is rotatable attached to the first frame 51 (cartridge frame), with a pair of bearings 31 (31*a* and 31*b*) placed between the photosensitive drum 1 and first frame 51. To one of the lengthwise ends of the photosensitive drum 1, a driving force is transmitted from a motor (unshown), rotationally driving the photosensitive drum 1 (in the counterclockwise direction). In the adjacencies of the peripheral surface of the photosensitive drum 1, the charge roller 2 as the means for uniformly charging the peripheral surface of the photosensitive drum 1, the cleaning blade 60 for removing the developer (residual developer) remaining on the peripheral surface of the photosensitive drum 1 after the image transfer, and a flexible sheet 80 are placed.

The charge roller 2 in this embodiment is of a contact type. It is an electrically conductive roller, and is placed in contact with the peripheral surface of the photosensitive drum 1. To the charge roller 2, a charge bias voltage is applied from the apparatus main assembly 100A. As a result, the peripheral surface of the photosensitive drum 1 is uniformly charged. The residual developer, that is, the developer remaining on the peripheral surface of the photosensitive drum 1 after the image transfer, reaches the cleaning blade 60, past the contact area between the aforementioned sheet 80 and the peripheral surface of the photosensitive drum 1. After being moved past the sheet 80, the residual developer is removed from the peripheral surface of the photosensitive drum 1 by the cleaning blade 60, and the residual developer (removed residual developer) is stored in a removed developer storage chamber 55 located in the rear portion of the first frame 51. The aforementioned sheet 80 is placed in contact with the peripheral surface of the photosensitive drum 1, in order to prevent the residual toner from leaking out of the first frame 51 after it is removed from the photosensitive drum 1 by the cleaning blade 60.

The development unit 4 has the development roller 40 and development unit frames 45*a* and 45*b*. The development roller 40 is rotated (in clockwise direction), with a minute gap maintained between the peripheral surfaces of the development roller 40 and photosensitive drum 1. The development unit frames 45*a* and 45*b* store the yellow, magenta, cyan, and black developers. They are joined to each other (by ultrasonic welding or the like), forming a second frame 45 (cartridge frame). The development roller 40 is rotatably supported by the second frame 45, with a pair of bearings (unshown) placed between the development roller 40 and second frame 45. Further, the development unit 4 comprises a developer supply roller 43, which is rotated (in clockwise direction) in contact with the development roller 40, and a development blade 44. Within the second frame 45, a developer conveying mechanism 42 is placed, which conveys the developer in the second frame 45, to the developer supply roller 42 while stirring the developer.

Figure 4:
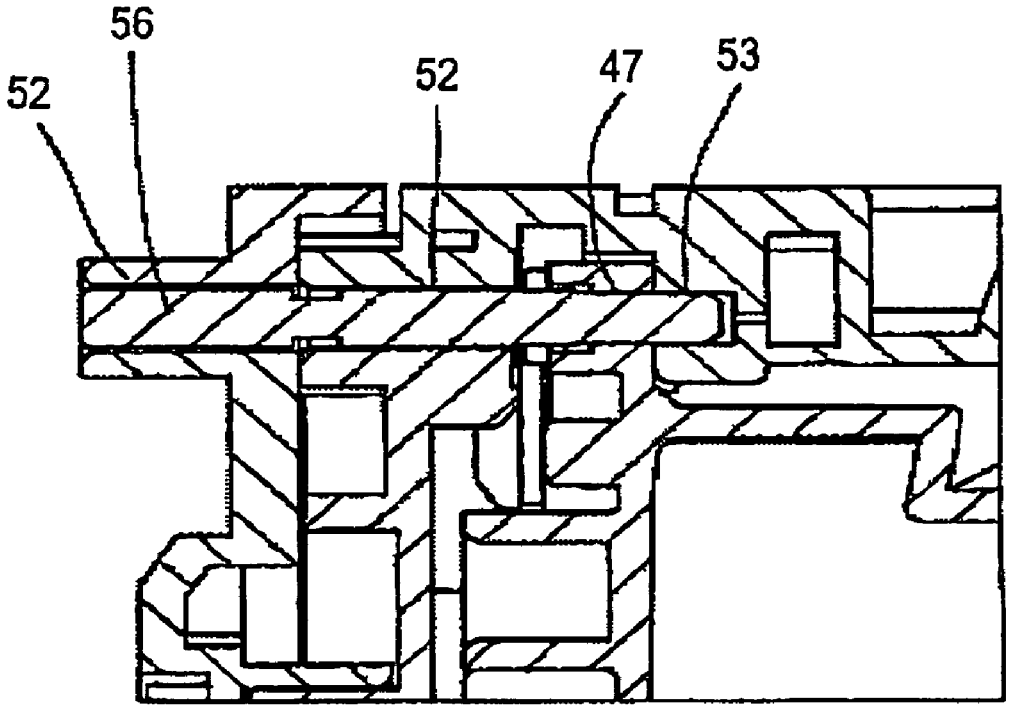
FIG. 4 is a sectional view of the process cartridge 7, at a plane e—e In FIG. 3(*b*).

FIG. 4 is a sectional view of the process cartridge 7, at a plane e—e in FIG. 3(*b*). Next, the structure for supporting the development unit 4 will be described. The second frame 45 is provided with a pair of connective holes 47, which are located at the lengthwise ends of the frame 45, one for one, whereas the cleaner unit 50 is provided with a pair of supportive hole 52 and 53, which are located at the lengthwise end of the unit 50, one for one. The development unit 4 and cleaner unit 50 are positioned so that the connective holes 47 and supportive holes 52 and 53 align, respectively. Then, a pair of connective pins 56 (57) are inserted through the supportive holes 52 and 53, and connective holes 47, from outward of the supportive holes 52 and 53, respectively. As a result, the development unit 4 and the cleaner unit 50 are connected to each other in such a manner that they are rotatable relative to each other. In other words, the development unit 4 is suspended from the cleaner unit 50, or vice versa. Further, a pair of springs 54 are placed between the development unit 4 and cleaner unit 50 so that the development unit 4 is kept pressed by the resiliency of the springs 54 in the direction to rotate about the pins 56 and 57. Therefore, the development roller 40 is kept pressed upon the photosensitive drum 1 (by the resiliency of the springs 54).

[Mounting of Process Cartridge into Main Assembly of Image Forming Apparatus, and Connection between Charge Voltage Contact of Process Cartridge and Charge Voltage Contact of Main Assembly]

Figure 5:
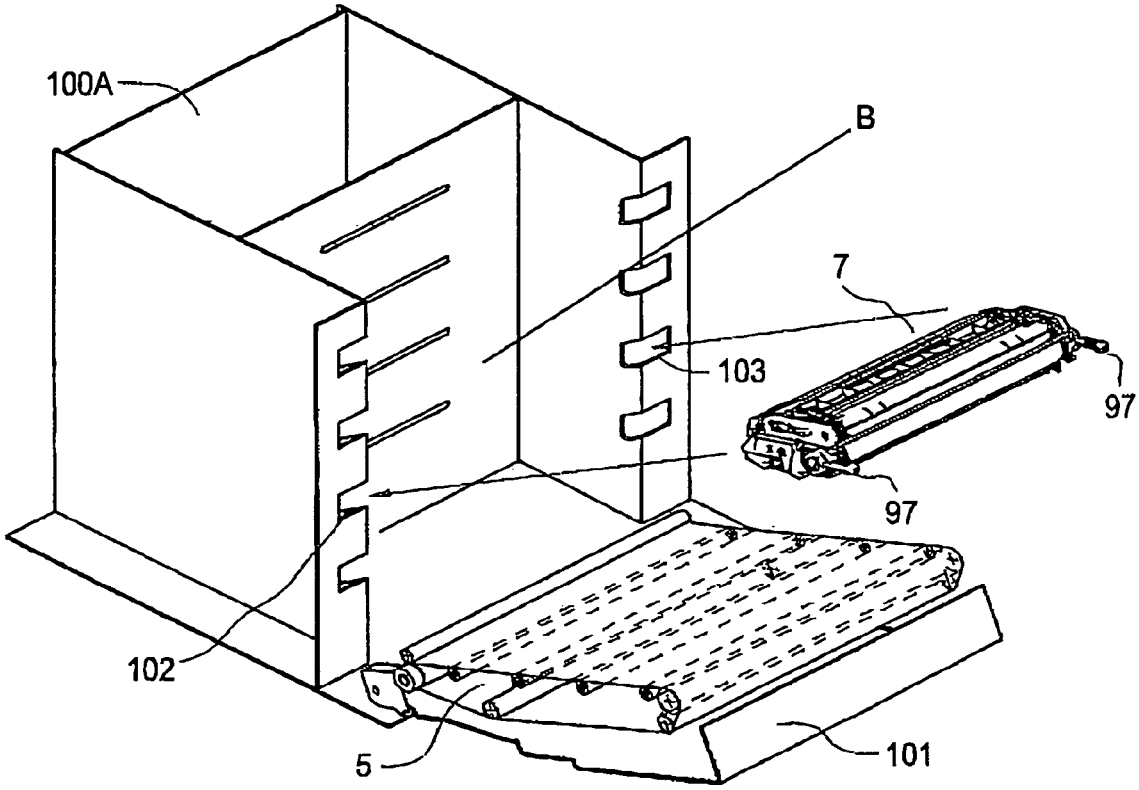
FIG. 5 is a schematic perspective view of the main assembly of the image forming apparatus, and process cartridge, in accordance with the present invention, showing how the process cartridge is mounted into the main assembly.

Next, referring to FIG. 5, the method for removably mounting the cartridge 7 into the apparatus main assembly 100A will be described. The apparatus main assembly 100A is provided with a front door 101 as shown in FIG. 5. This front door 101 is rotatably attached to the apparatus main assembly 100A. Further, the aforementioned transferring apparatus 5 is attached to the inward side of the front door 101. In other words, the front door 101 and transferring apparatus 5 are attached to the apparatus man assembly 100A so that they can be rotatably opened or closed against the apparatus main assembly 100A. When the front door 101 and transferring apparatus 5 are open, the cartridges 7 are removably mountable in the apparatus main assembly 100A. Each cartridge 7 is provided with a pair of handles 97, which are located at the lengthwise ends of the cartridge 7, one for one. When a user intends to mount the cartridge 7 into the apparatus main assembly 100A, the user is to hold the cartridge 7 by the pair of handles, and to insert the cartridge 7 between a pair of cartridge guiding members 102 and 103 of the apparatus main assembly 100A. The cartridge guiding member 102 is located at one end of the cartridge compartment B of the apparatus main assembly 100A, and the cartridge guiding member 103 is located at the other end of the cartridge compartment B. Each of the cartridge guiding members 102 and 103 is provided with a pair of guides 104 and 105 for guiding the cartridge 7 into the cartridge compartment B. In terms of the vertical direction, the guide 104 is located below the guide 105. In other words, four sets of guides 104 and 105 are located at each end of the cartridge compartment B, to guide the four cartridges 7 one for one.

Figure 6:
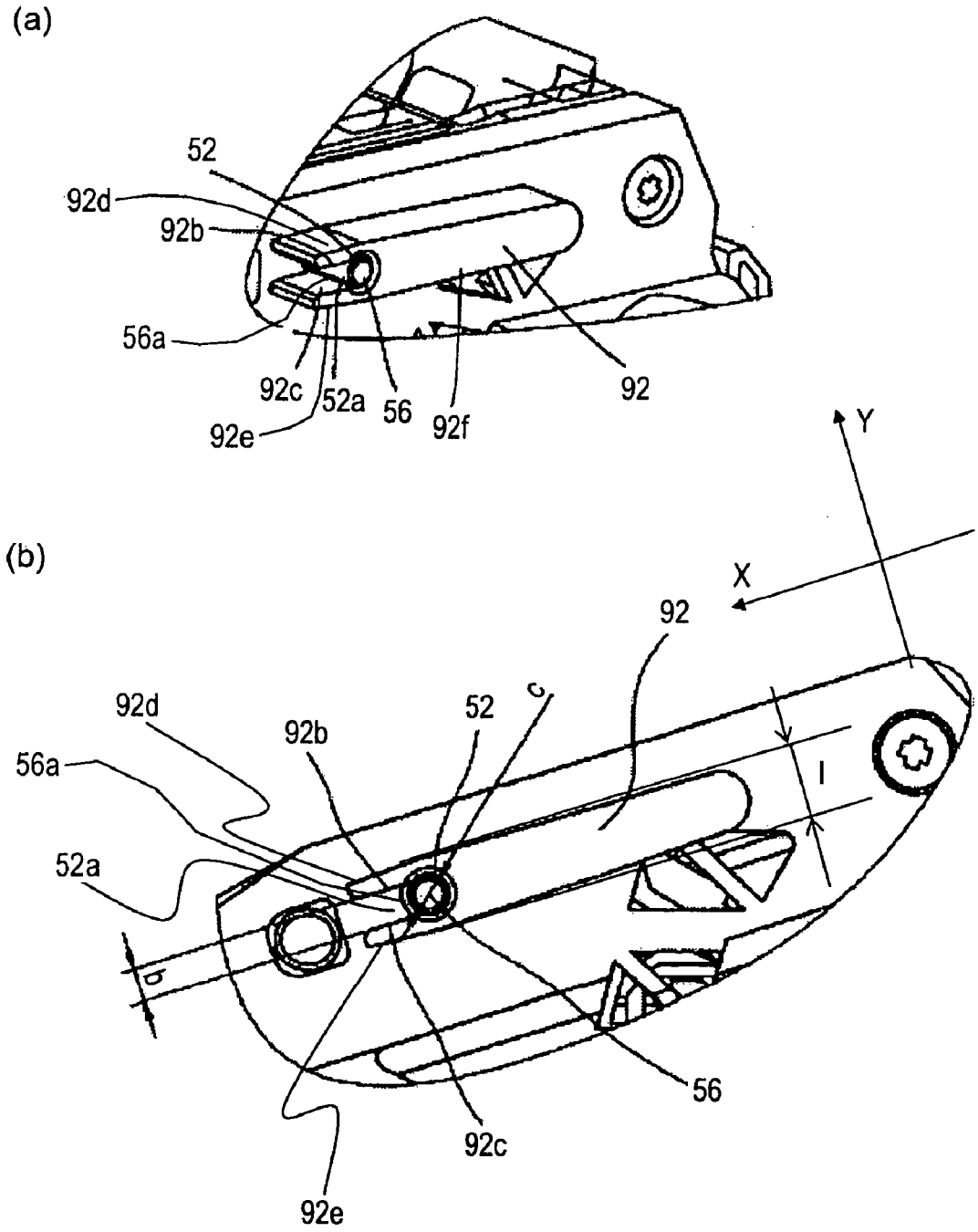
FIGS. 6(*a*) and 6(*b*) are perspective views of the process cartridge in accordance with the present invention.

FIGS. 6(*a*) and 6(*b*) are enlarged views of one of the lengthwise ends of the cartridge 7 in terms of the lengthwise direction of the photosensitive drum 1. One of the lengthwise ends of the cartridge 7 is provided with a cartridge boss 90 and a cartridge guide 92, which project from the cleaner unit 50 in the lengthwise direction of the photosensitive drum 1 (FIG. 3(*b*)), whereas the other end is provided with a cartridge boss 91 and a cartridge guide 93, which also project from the cleaner unit 50 in the lengthwise direction of the photosensitive drum 1 (FIG. 3(*a*)). When the cartridge 7 is inserted into the apparatus main assembly 100A, these guides 92 and 93 fit into the grooves of the aforementioned guides 105 of the apparatus main assembly 100A, being thereby regulated by the guides 105 in terms of the their movements in the lengthwise direction (direction Z) and height direction (direction Y). More specifically, the guides 92 and 93 are regulated by the top surface 92*d* (first surface by which guide 92 is guided), bottom surface 92*e* (second surface by which guide 92 is guided), and lateral surface 92*f*, of the guide 92, in terms of the direction in which it is allowed to move. In other words, the guides 92 and 93 are regulated by the top internal surface (top internal surface of groove of guide) 105*d*, bottom internal surface (bottom internal surface of groove) 105*e*, and lateral surface (bottom surface of groove) 105*f*, of the guide 105 of the apparatus main assembly 100A, in terms of the direction in which it is allowed to move. In other words, the cartridge 7 is regulated by the contact between the top surface 92*d* and top internal surface 105*d*, contact between the bottom surface 92*e* and internal bottom surface 105*e*, and contact between the lateral surface 92*f* and lateral surface 105*f*, in terms of the direction in which it is allowed to move. Therefore, the cartridge 7 is accurately guided into the cartridge compartment B. The manner in which the cartridge 7 is guided by the guide 93 is the same as that by the guide 92, and therefore, will not disclosed here. Also when the cartridge 7 is mounted into the apparatus main assembly 100A, the bosses 90 and 91 are regulated by the guides 104 of the apparatus main assembly 100A in terms of the direction in which they are allowed to move. The bosses 90 and 91 are formed of resin, and are roughly 20 mm in external diameter. They are positioned so that their axial lines coincide with the axial line of the photosensitive drum 1. The guides 92 and 93 are roughly 7 mm in width, and roughly 7 mm in height. They extend in the direction roughly parallel to the direction X in which the cartridge 7 is mounted into the apparatus main assembly 100A. The bosses 90 and 91, and guides 92 and 93, are integrated with the bearings 31*a* and 31*b*, respectively. The guides 92 and 93 project outward from the unit 50 in the lengthwise direction. In terms of the direction (direction X) in which the cartridge 7 is inserted into the apparatus main assembly 100A, the aforementioned supportive holes 52 and 53 are located on the downstream side of the guides 92 and 93, near the guide 92 and 93, respectively. The end surfaces of the pins 56 and 57 inserted in the supportive holes 52 and 53 are roughly level with the end surfaces of the guides 92 and 93, respectively. Of the two pins 56 and 57, the pin 56 is formed of metal, roughly 3 mm in diameter, electrically conductive, and cylindrical. The pin 57 is formed of resin.

Figure 10:
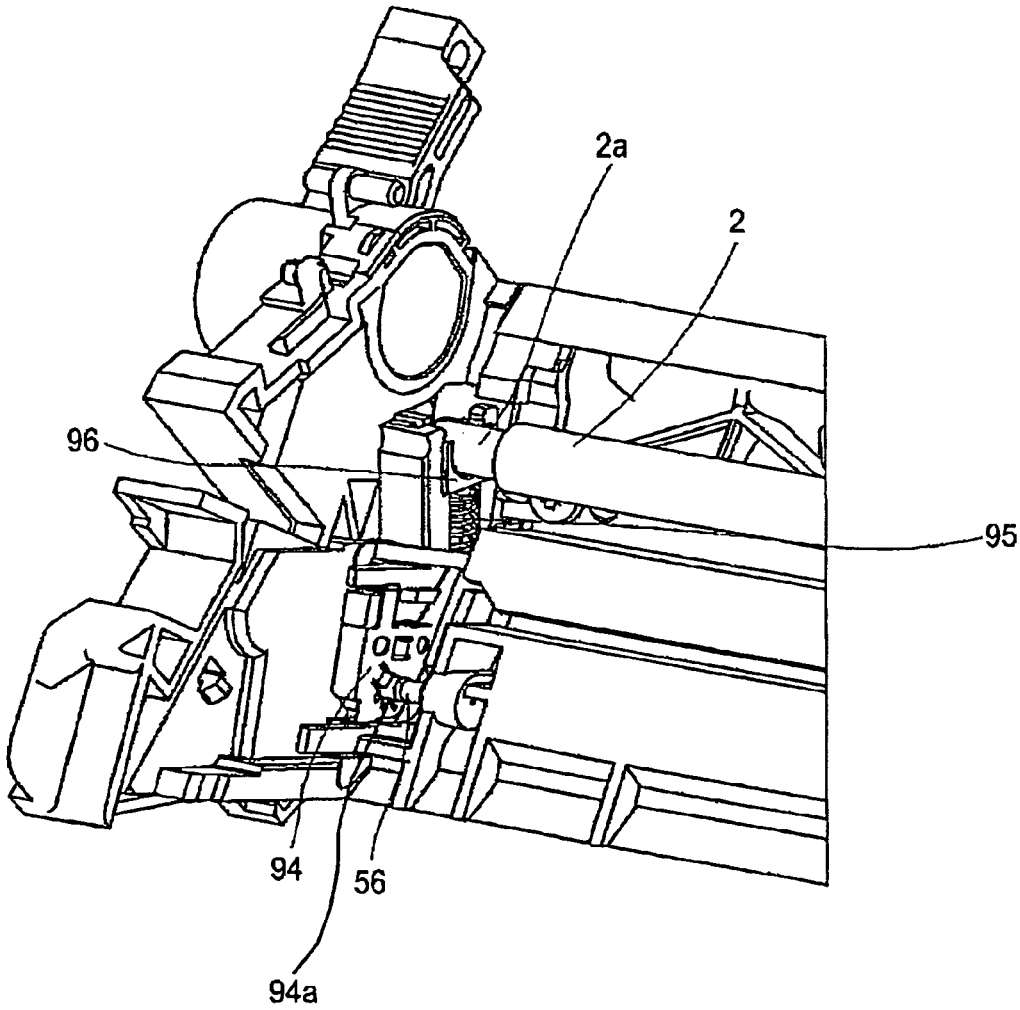
FIG. 10 is a perspective view of the lengthwise end of the process cartridge having the electrical contacts, and the corresponding portion of the cartridge compartment of the main assembly of the image forming apparatus, showing the path through which voltage is applied to the charge roller in the process cartridge from the high voltage power source of the main assembly.

Next, referring to FIG. 10, the electricity path from the apparatus main assembly 100A to the charge roller 2 located in the cartridge 7 will be described. To begin with, a cleaner unit 50 is provided with a charge bias contact plate 94, which is located inside one of the lengthwise ends of the cleaner unit 50. The charge bias contact plate 94 is provided with a hole 94*a*, in which the aforementioned pin 56 is fitted; pin 56 is pressed into the hole 94*a*. In other words, the pin 56 and contact plate 94 are electrically connected with each other. The contact plate 94 is in contact (electrically connected) with a spring 95 (coil spring), which is in contact (electrically connected) with a charge roller bearing 96 formed of electrically conductive resin to rotatably support one of the lengthwise ends of the charge roller 2. With the provision of this structural arrangement, as the cartridge 7 is mounted into the cartridge compartment B, the pin 56 comes into contact with the electrical contact 106, in the form of a spring, of the apparatus main assembly 100A, making it possible for voltage to be supplied from the apparatus main assembly 100A through the contact spring 106; charge bias is supplied to the charge roller 2 through the pin 56. In other words, the pin 56 functions as the electrical contact, on the cartridge side, for supplying the charge roller 2 with the electric power from the apparatus main assembly 100A, whereas the contact spring 106 on the apparatus main assembly 100A functions as the electrical contact on the main assembly side. The pin 56 is provided with an electrical contact 56*a*, as the electrical contact on the cartridge side, which is exposed outward from the first frame 51, whereas the contact spring 106 is provided with an electrical contact 106*a*, as the electrical contact on the main assembly side, which is elastic. The contact 106*a* of the contact spring 106 of the apparatus main assembly 100A is exposed from the inward surface of the cartridge compartment B. Thus, as the cartridge 7 is mounted into the apparatus main assembly 100A, the contact 56*a* comes into contact with the contact 106*a*, establishing an electrical connection between them. More specifically, the two contacts 56*a* and 106*a* are reliably kept in contact with each other, since the contact 106*a* is kept pressed on the contact 56*a* by the resiliency of the contact 106*a*. The electrical contact (contact 56*a*) on the cartridge side is the portion of the pin 56, which contacts the electrical contact on the main assembly side, whereas the electrical contact (contact 106*a*) on the main assembly side is a part of the contact spring 106.

Next, referring to FIGS. 3(*b*), 6(*a*), and 6(*b*), the guide 92 of the cartridge 7 is provided with a recess (groove) 52*a*, which is open at the downstream end f the guide 92, in terms of the direction (X) in which the cartridge 7 is mounted into the apparatus main assembly 100A. The groove 52*a* is deep enough to reach the pin 56, and has a predetermined width. More specifically, in terms of the height direction (Y) of the groove 52*a*, which is perpendicular to the aforementioned cartridge mounting direction, the groove 52*a* is within the guide 92. In other words, in terms of the cartridge mounting direction, the bottom surface of the groove 52*a* coincides with the outward end of the pin 56 (supportive hole 52), and the grooves 52*a* extends in the downstream direction. Thus, a part of the pin 56 is exposed from the first frame 51, and a part of this exposed portion of the pin 56 functions as the contact 56*a*. In this embodiment, the width b of the groove 52*a* is roughly 2.95 mm, being slightly less than the external diameter c (3.0 mm) of the pin 56. With the provision of this structural arrangement, when the cartridge 7 is mounted into the apparatus main assembly 100A, the cartridge 7 is regulated by the top and bottom internal surfaces 92*b* and 92*c* of the groove 52*a* in terms of the movement in the aforementioned height direction (direction Y), being therefore guided in a manner to ensure that the contact 56*a* comes into contact with the contact 106*a*. Therefore, the cartridge 7 and apparatus main assembly 100A are improved in terms of the reliability concerning the electrical contact between the cartridge 7 and apparatus main assembly 100A. Further, the movement of the cartridge 7 in the lengthwise direction is regulated by the guides 104 and 105 on the main assembly side. Therefore, the cartridge 7 is prevented from wandering in the lengthwise direction. Therefore, as long as the cartridge 7 is guided while being regulated in terms of the movement in the aforementioned height direction (direction Y), it is assured that the contact 56*a* of the pin 56 is guided to the contact 106*a*. In addition, the groove 52*a* is open on the downstream side, in terms of cartridge mounting direction (X), and has the top and bottom internal surfaces 92*b* and 92*c* as the first and second guiding portions, respectively, which oppose each other. Further, the top and bottom internal surfaces 92*b* and 92*c* are roughly parallel to the direction (x) in which the cartridge 7 is mounted into the apparatus main assembly 100A. The contact 56*a* is positioned between the top and bottom internal surfaces 92*b* and 92*c*, in terms of the aforementioned height direction (Y), whereas in terms of the cartridge mounting direction X, the contact 56*a* is on the upstream side of the top and bottom internal surfaces 92*b* and 92*c*. That the contact 56*a* is between the top and bottom internal surfaces 92*b* and 92*c* does not mean that the contact 56*a* must overlap with the top and bottom internal surfaces 92*b* and 92*c* in terms of the cartridge mounting direction X. In other words, all that is necessary is that the positional relationship among the top and bottom internal surfaces 92*b* and 92*c*, and contact 56*a*, is such that the contact 56*a* is guided to the contact 106*a*. The outward end of the pin 56 is exposed from the portion of the first frame 51, which coincides with the groove 52*a*. A part of this exposed portion of the pin 56 functions as the aforementioned contact 56*a*. Thus, the top and bottom internal surfaces 92*b* and 92*c* regulate the direction of the movement of the contact 106*a* relative to the contact 56*a*; they guide the exposed portion of the pin 56*a* to the contact 106*a*. Therefore, the contact 56*a* is reliably placed in contact with the contact 106*a*, without increasing in size the exposed portion, as the contact 56*a*, of the pin 56 in order to ensure that the contact 56*a* is placed in contact with the electrical contact on the main assembly side.

Figure 7:
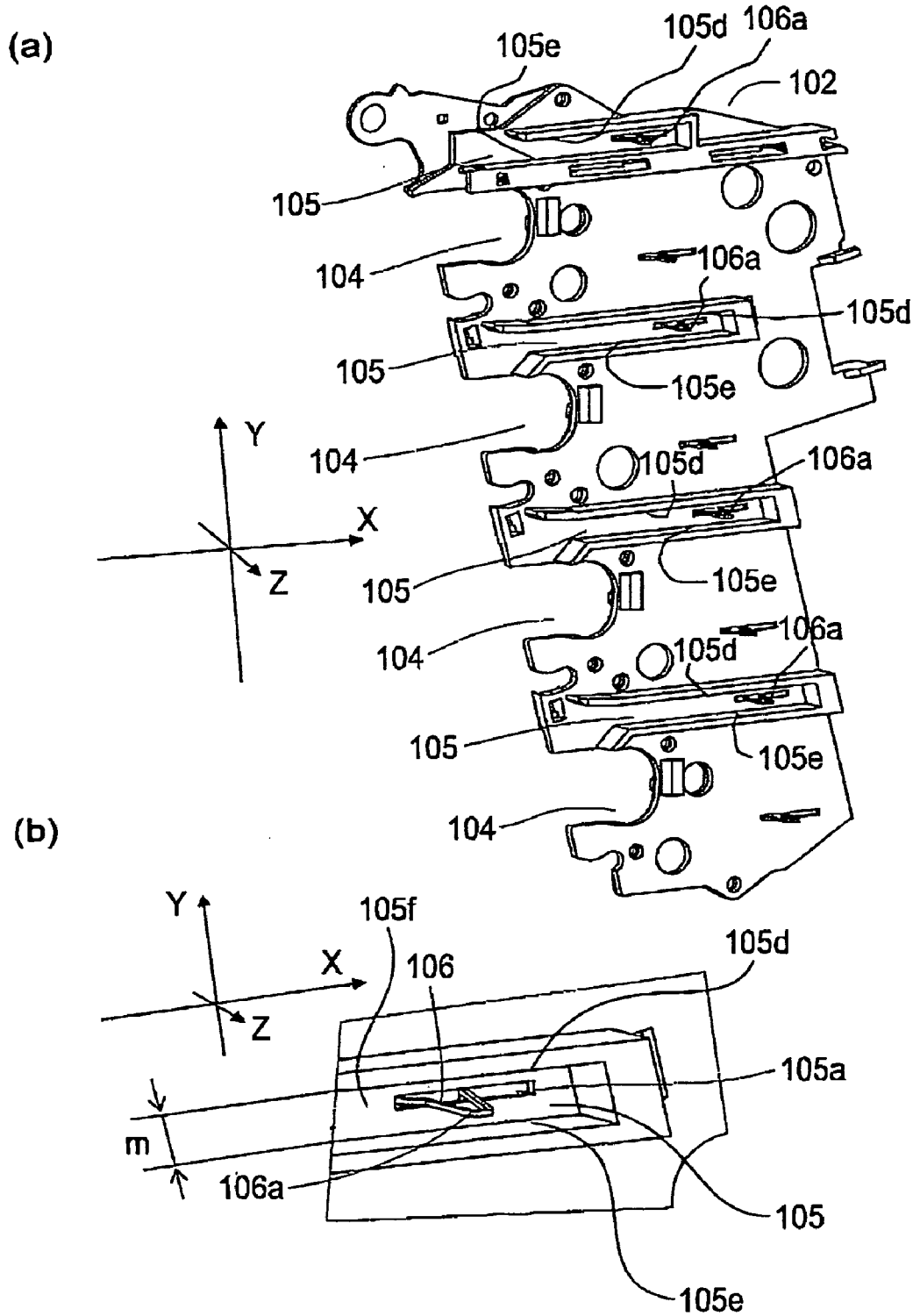
FIGS. 7(*a*) and 7(*b*) are perspective views of the process cartridge guide, located at one end of the cartridge compartment of the main assembly of the image forming apparatus, in terms of a direction perpendicular to the direction in which the cartridge is mounted into the main assembly, in the first embodiment of the present invention.

Next, referring to FIG. 7, the cartridge guiding member 102 of the apparatus main assembly 100A, located at one end of the apparatus main assembly 100A, will be described. The cartridge guiding member 102 is formed of resin. It is a monolithic member and is enabled to cover the lengthwise ends of all of the mounted four cartridges 7. It is provided with a guides 104 and 105. When the cartridge 7 is mounted into the cartridge compartment B, the guide 104 engages with the boss 90 of the cartridge 7. As for the guide 105, it engages with the guide 92 of the cartridge 7. To describe in more detail, when the cartridge 7 is mounted into the cartridge compartment B, the guide 105 guides the guide 92 by the outward surface of the guide 92. In other words, the guide 92 is guided by the guide 105 by the top and bottom surfaces 92*d* and 92*e* of the guide 92, respectively. With this structural arrangement, the cartridge 7 is precisely guided into the cartridge compartment B (inside of the apparatus main assembly 100A). In terms of the thickness direction (direction Y) of the cartridge 7, the aforementioned top and bottom internal surfaces 92*b* and 92*c* are between the top and bottom surface 92*d* and 92*e*. In other words, the top and bottom internal surfaces 92*b* and 92*c* for guiding the contact 56*a* to a spring 106 (as electrical contact) are located between the top surface 92*d* by which the guide 92 is guided by the top internal surface 105*d* of the guide 105 on the main assembly side, and the bottom surface 92*e* of the guide 92, by which the guide 92 is guided by the bottom internal surface of the guide 105 on the main assembly side. Therefore, during the insertion of the cartridge 7 into the apparatus main assembly 100A, the contact 56*a* is guided to the spring 106 (as electrical contact) by the portions of the cartridge 7 smallest in the amount of wandering. Therefore, the contact 56*a* is precisely guided to the contact 106*a*. Since the contact 56*a* is placed in contact with the contact 106*a* at the location where the amount of the wandering of the cartridge 7 is smallest, the contacts 106*a* and 56*a* do not need to be large; it is unnecessary to increase in size the contact 106*a* and 56*a* in order to ensure that they contact each other. Therefore, it is possible to reduce in size the cartridge 7 and apparatus main assembly 100A.

The guide 105 on the main assembly side has a groove defined by the top internal surface 105*d*, the bottom internal surface 105*e*, and the internal surface 105*f*, which extends in the cartridge mounting direction (direction X), and in the groove, the lateral surface 105*f* has an elongated hole 105*a* which extends parallel to the cartridge mounting direction. From this elongated hole 105*a*, the aforementioned contact 106a of the spring 106 protrudes inward into the cartridge compartment B (FIG. 5). The spring 106 is a torsional coil spring, the wire of which is roughly 1 mm in diameter. A part of the coil spring 106 is bent, and a part of this bent portion is the contact 106*a*. The rotational axis of the torsional coil spring 106 is roughly parallel to the aforementioned thickness direction (direction Y). In this embodiment, the contact 106*a* of the spring 106 is movable along the guide 92 (in the direction parallel to the cartridge mounting direction). Therefore, not only is it possible to reduce the size of the space necessary for the electrical contact of the apparatus main assembly 100A, but also, the electrical contact of the cartridge 7. Further, compared to the immovable electrical contact, or the electrical contact structured so that it can be moved in the aforementioned thickness direction, the electrical contacts in this embodiment afford more latitude in designing the cartridge 7 and apparatus main assembly 100A, in terms of material, structure, etc. Further, the contact 106*a* of the spring 106 presses the pin 56 in the direction parallel to the axial line of the pin 56 (lengthwise direction (Z) of photosensitive drum 1).

Figure 9:
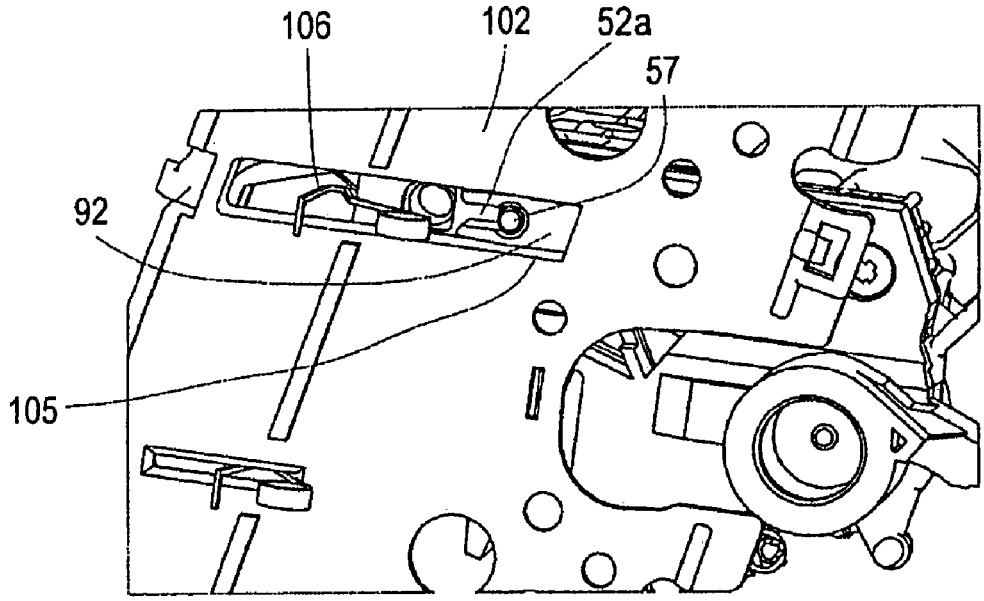
FIGS. 9(*a*) and 9(*b*) are perspective views of the process cartridge guide of the main assembly of the image forming apparatus, and process cartridge, in the first embodiment of the present invention, showing the stages through which the electrical contact on the cartridge side comes into contact with the electrical contact on the main assembly side of the image forming apparatus.
Figure 9:
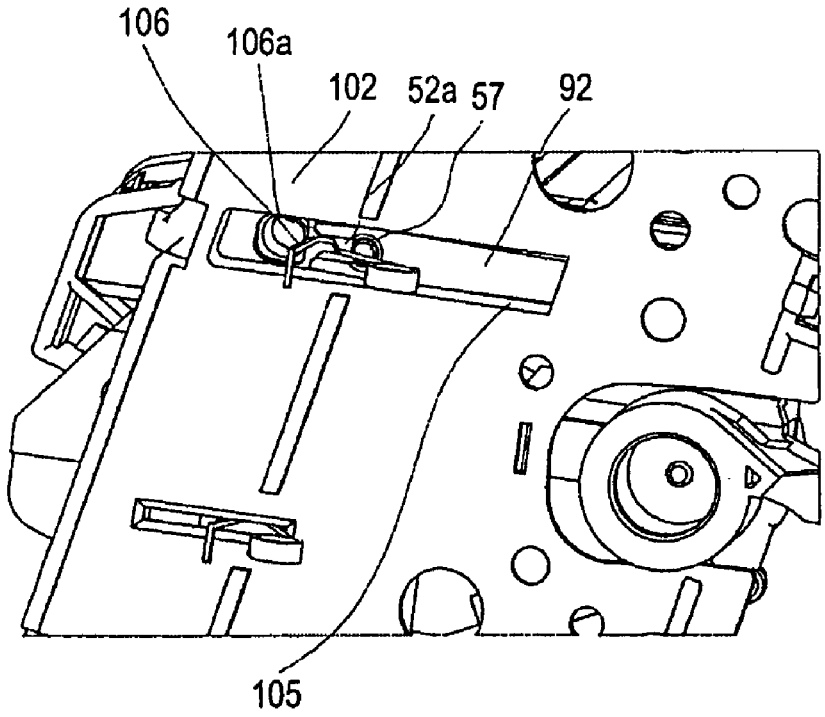

Next, referring to FIG. 9, the steps, through which the electrical contact of the apparatus main assembly 100A is connected to the electrical contact of the cartridge 7, as the cartridge 7 is mounted into the apparatus main assembly 100 will be described. FIG. 9 is a perspective view of the backside of the cartridge guide 102 located at one end of the apparatus main assembly 100A. In the drawing, certain portions of the cartridge guide 102 are not illustrated, in order to make it easier to understand the guide 92 and its adjacencies.

Figure 8:
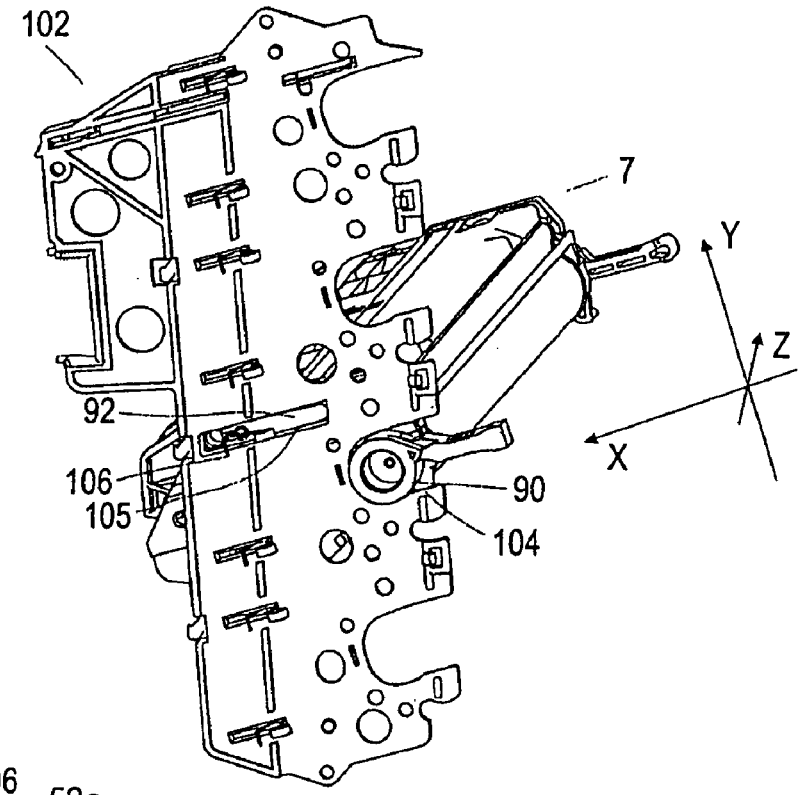
FIGS. 8(*a*) and 8(*b*) are perspective views of the process cartridge guide of the main assembly of the image forming apparatus, located at one end of the cartridge compartment of the main assembly of the image forming apparatus, in terms of a direction perpendicular to the direction in which the cartridge is mounted into the main assembly, and the corresponding lengthwise end of the cartridge, in the first embodiment of the present invention, showing the electrical contact on the cartridge side and electrical contact on the main assembly side, which are in contact with each other.
Figure 8:
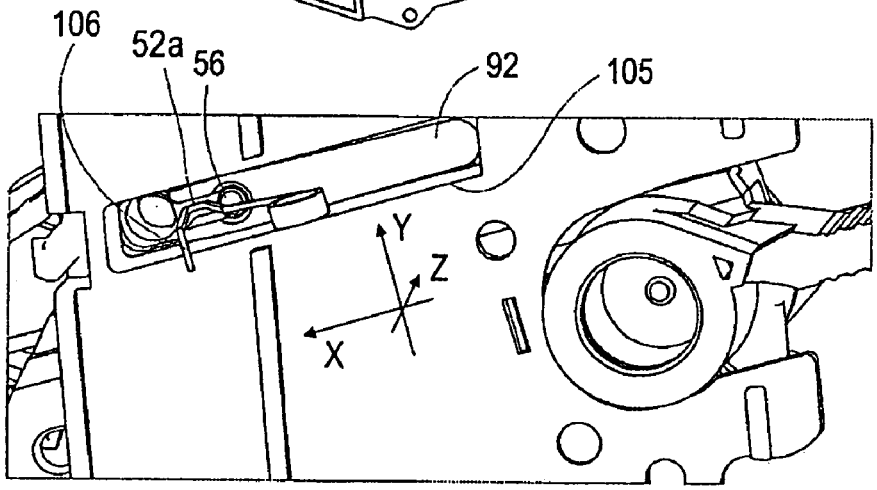

First, a user inserts the cartridge 7 into the apparatus main assembly 100A. As the cartridge 7 is inserted, the guide 92 is guided by the guide 105 on the main assembly side, by the outward surfaces, as shown in FIG. 9(*a*). The width m (FIG. 7(*b*)) of the guide 105 on the main assembly side is set to be roughly 0.5 mm greater than the width 1 (FIG. 6(*b*)) of the guide 92 on the cartridge side, stabilizing the cartridge 7 in attitude while preventing the force necessary to be applied to insert the cartridge 7, from becoming excessive. Therefore, the user can smoothly mount the cartridge 7 into the apparatus main assembly 100A. As the cartridge 7 is further inserted as shown in FIG. 9(*b*), the spring 106 enters the groove 52*a* of the guide 92. In other words, the contact 106*a* of the spring 106 is guided by the groove 52*a* of the guide 92. Since the spring 106, or the electrical contact on the main assembly side, is regulated by the groove 52*a*, the contacts 56*a* and 106*a* do not need to be as wide as the contact area of an electrical contact in the form of a plate spring, and yet, the contact 56*a* can be reliably guided to the contact 106*a*. As the cartridge 7 is mounted into the deepest end of the cartridge compartment B, that is, at the end of the mounting of the cartridge 7 into the apparatus main assembly 100A, the end (contact 56*a*) of the pin 56 comes into contact with the bent portion, or contact 106*a*, of the spring 106 (stage shown in FIG. 8). At this point in time, the contact pressure between the spring 106 and pin 56 is in the range of 50–100 gf. The wire, of which the spring 106 is made, is circular in diameter, and so is the pin 56. Therefore, the contacts 56*a* and 106*a* are likely to slide on each other. However, the widths b between the first guiding portion 92*b* and second guiding portion 92*c* is made slightly less than the external diameter c of the pin 56 (FIG. 6(*b*)). Therefore, the contacts 106*a* and 56*a* are always kept in contact with each other, ensuring that the cartridge 7 is reliably supplied with electric power.

With the employment of the above described structural arrangement, it is assured that when mounting the cartridge 7, the contact 56*a* of the cartridge 7 is guided to the contact 106*a* of the apparatus main assembly 100A, and that the two contacts 56*a* and 106*a* do not disengage from each other after their contact. Further, the employment of the above described structural arrangement eliminates such a problem that the contacts are deformed due to the accidental disengagement, or the like. Further, it ensures that even after the cartridge 7 is completely mounted, the contact 106*a* remains in contact with the contact 56*a*, making it therefore possible to reduce in size the portion of the cartridge 7 for the contact. In other words, this embodiment makes it unnecessary to adjust the size of the electrical contact of the cartridge 7, in consideration of the tolerances (estimated errors) allowed for the manufacture of a cartridge and main assembly of an image forming apparatus, in order to ensure that the electrical contact on the cartridge side comes, and remains, in contact with the electrical contact on the main assembly side. Therefore, the employment of the above described structure arrangement makes it possible to reduce in size the cartridge 7, and also, the main assembly 100A. In summary, this embodiment makes it possible to reduce in size the cartridge 7 without lowing the level of reliability at which electric power is supplied from the apparatus main assembly 100A to the cartridge 7.

Further, in the case of a color image forming apparatus, such as the one in the above described embodiment, which employs a vertical inline image formation system, and in which the cartridge 7 is supplied with electric power through one of the lengthwise ends (in terms of axial direction of photosensitive drum 1) of the cartridge 7, the space at the lengthwise end of the cartridge 7, which must be reserved for the electrical contact, is smaller in size, making it therefore possible to reduce the distance between the photosensitive drums 1 in the adjacent two cartridges 7, which in turn makes it possible to reduce the height of the apparatus main assembly 100A.

In the above described embodiment, the cartridge 7 is structured so that the pin 56, which is one of the pins connecting the cleaning unit 50 and development unit 4, is made to function as the electrical contact of the cartridge 7. However, the cartridge 7 can be reduced in size even if one of the members connecting the two units 50 and 4 is not made to function as the electrical contact of the cartridge 7. However, the employment of the structural arrangement in this embodiment, the pin 56, the diameter of which is relatively small, can be made to function as the electrical contact on the cartridge side; in other words, the electrical contact is substantially smaller than that in accordance with the prior art. Therefore, it is possible to reduce in size the space necessary for the electrical contact. Therefore, it is possible to make the cartridge 7 smaller than a process cartridge in accordance with the prior art.

Also in the description of the embodiment given above, the present invention was described with reference to the electrical contact of the charge roller 2. However, the present invention is also applicable to the electrical contacts for supplying the processing means other than the charge roller 2, for example, the developing means, cleaning means, etc., with electric power.

Also in the above described embodiment, the pin 56 is a piece of rod which is circular in cross section. However, the present invention is compatible with a process cartridge, the connective pins of which are not circular in cross section. For example, it is applicable to a process cartridge, the connective pins of which are in the form of a piece of rod which is square in cross section.

Also in the above described embodiment, the electrophotographic photosensitive member is in the form of a drum. However, the present invention is also applicable to a process cartridge, the photosensitive member of which is in the form of a belt. However, since the electrophotographic photosensitive member in the form of a drum takes up less space, it is better suited for the reduction of cartridge size.

[Embodiment 2]

Figure 11:
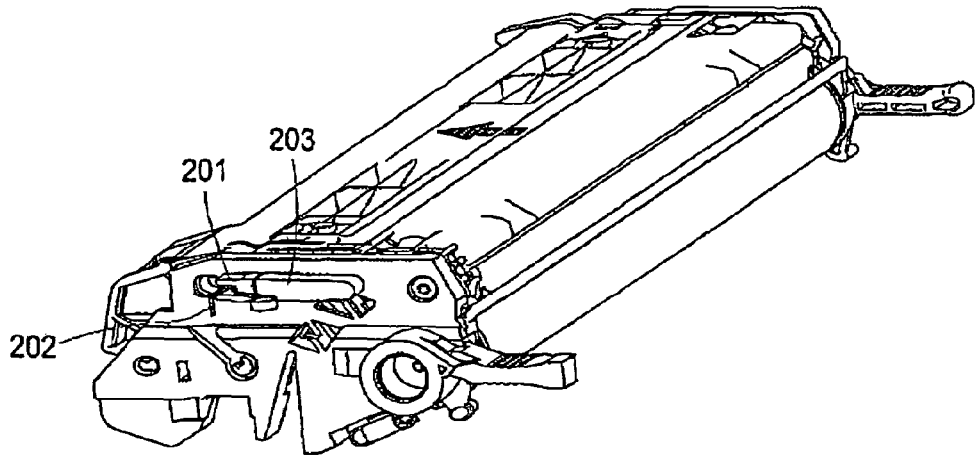
FIGS. 11(*a*) and 11(*b*) are perspective views of the electrical contact on the main assembly side, and the entirety of the process cartridge, in the second embodiment of the present invention.
Figure 11:
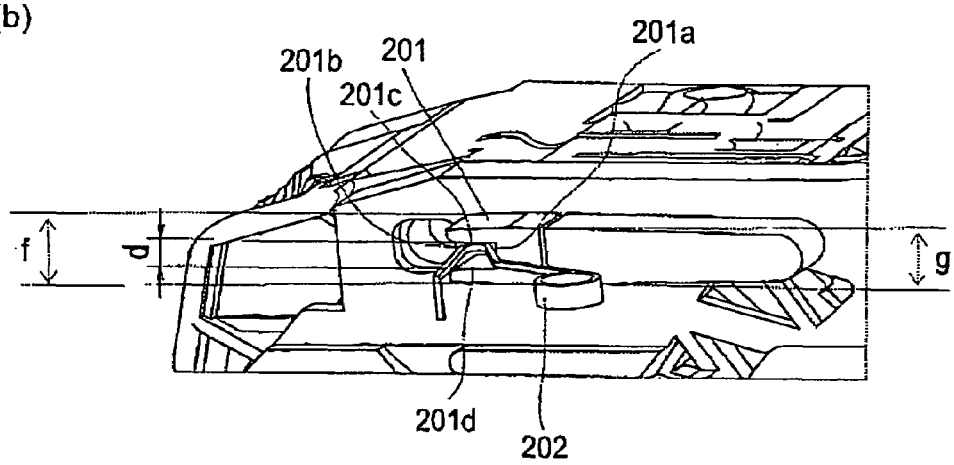

Next, referring to FIG. 11, the second embodiment of the present invention will be described. The portions of the cartridge and apparatus main assembly in this embodiment, which are similar to those in the first embodiment, will not be described here. FIG. 11(*a*) is a perspective view of the entirety of the process cartridge in this embodiment, whereas FIG. 11(*b*) is a perspective view of the electrical contact area between the process cartridge and apparatus main assembly, and its adjacencies.

In this embodiment, the connective pin 201 is provided with a cartridge guide portion 201*b*, which is an integral part of the connective pin 201. The connective pin 201 is shaped so that as it is put through the connective hole and supportive hole, the top surface of the cartridge guide portion 201*b* becomes level with that of the cartridge guide 203. Therefore, when the cartridge 7 is mounted into the apparatus main assembly 100A, the cartridge 7 is guided by the combination of the cartridge guide portion 201*b* of the electrical contact 201 (connective pin) and guide 203, which form virtually straight line.

Both the actual contact 201*a* and guide portion 201*b* of the electrical contact 201 are formed of metallic substance. Therefore, the gap d of the cartridge guide portion 201*b* can be further reduced, because even if the contact guides 201*c* and 201*d* come into contact with the electrical contact 202 on the main assembly side, electric power can still be supplied to the cartridge 7. Therefore, the cartridge size can be further reduced.

Further, the width f of the cartridge guide portion 201*b* of the pin 201 may be made less than the width g of the guide 203 so that when the cartridge 7 is mounted into the apparatus main assembly 100A, the cartridge 7 is guided by the guide 203 alone. Such a modification can yield the same effects as those realized by the first embodiment.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 279247/2004 filed Sep. 27, 2004, which is hereby incorporated by reference.

What is claimed is:

1. A cartridge detachably mountable to a mounting portion provided in a main assembly of an electrophotographic image forming apparatus, said cartridge comprising:

a cartridge electrical contact configured and positioned to supply electric power to process means actable on an electrophotographic photosensitive member from the main assembly of the apparatus, said cartridge electrical contact being electrically connectable to a main assembly electrical contact provided in the main assembly of the apparatus when said cartridge is mounted to the mounting portion;

a first portion to be guided and a second portion to be guided configured and positioned to be guided by a main assembly guide provided in the main assembly of the apparatus to guide said cartridge to the mounting portion when said cartridge is mounted to the mounting portion; and a guide configured and positioned to guide the main assembly electrical contact to said cartridge electrical contact to establish an electrical connection between the main assembly electrical contact and said cartridge electrical contact when said cartridge is mounted to the mounting portion, wherein said guide and said cartridge electrical contact are disposed between said first portion to be guided and said second portion to be guided, and said cartridge electrical contact is disposed upstream of said guide with respect to a direction in which said cartridge is mounted to the mounting portion.

2. A cartridge according to claim 1, wherein said cartridge further comprises a frame and a projected portion projected at one longitudinal end of said frame, wherein said first portion to be guided is a part of one end surface of said projected portion and said second portion to be guided is a part of the other end surface of said projected portion.

3. A cartridge according to claim 2, wherein said guide comprises first and second guides, wherein said projected portion has a recess and wherein said first guide is a part of one end of an inner surface of the recess and said second guide is a part of the other end of the inner surface of said recess.

4. A cartridge according to claim 3, wherein said cartridge electrical contact is disposed upstream of said recess in the mounting direction.

5. A cartridge according to claim 1, further comprising a first frame rotatably supporting the electrophotographic photosensitive member, a developing roller configured and positioned to develop an electrostatic latent image formed on the electrophotographic photosensitive member, and a second frame supporting said developing roller, wherein said cartridge electrical contact is a part of an electroconductive connection pin configured and positioned to rotatably connect said first frame and said second frame with each other.

6. A cartridge according to claim 1, wherein said cartridge is a process cartridge containing the electrophotographic photosensitive member.

7. A cartridge according to claim 1, wherein said guide comprises a first guide and a second guide which are opposed to each other.

8. A cartridge according to claim 7, wherein said cartridge electrical contact is disposed between said first guide and said second guide.

9. A process cartridge detachably mountable to a mounting portion provided in a main assembly of an electrophotographic image forming apparatus, said process cartridge comprising:

an electrophotographic photosensitive member;

a first frame rotatable supporting said electrophotographic photosensitive member;

a developing roller configured and positioned to develop an electrostatic latent image formed on said electrophotographic photosensitive member;

a second frame rotatably supporting said developing roller;

an electroconductive connection pin rotatably connecting said first frame and said second frame with each other, said electroconductive connection pin being electrically connectable to a main assembly electrical contact provided in the main assembly of the apparatus when said process cartridge is mounted to the mounting portion;

a first portion to be guided and a second portion to be guided configured and positioned to be guided by a main assembly guide provided in the main assembly of the apparatus to guide said cartridge to the mounting portion when said process cartridge is mounted to the mounting portion; and a guide configured and positioned to guide the main assembly electrical contact to said connection pin so as to establish an electrical connection between the main assembly electrical contact and said connection pin when said cartridge is mounted to the mounting portion, wherein said guide is disposed between said first portion to be guided and said second portion to be guided, and said cartridge electrical contact is disposed upstream of said guide with respect to a direction in which said cartridge is mounted to the mounting portion.

10. A process cartridge according to claim 9, further comprising a projected portion projected at one longitudinal end of said first frame, wherein said first portion to be guided is a part of one end surface of said projected portion, and said second portion to be guided is a part of the other end surface of said projected portion.

11. A process cartridge according to claim 10, wherein said guide comprises first and second guides, wherein said projected portion has a recess and wherein said first guide is a part of one end of an inner surface of the recess and said second guide is a part of the other end of the inner surface of the recess.

12. A process cartridge according to claim 11, wherein said cartridge electrical contact is disposed upstream of the recess in the mounting direction.

13. An electrophotographic image forming apparatus for forming an image on a recording material, said electrophotographic image forming apparatus comprising:

a mounting portion;

a cartridge detachably mounted to said mounting portion, said electrophotographic image forming apparatus forming the image on the recording material using said cartridge;

a main assembly electrical contact configured and positioned to electrically connect to a cartridge electrical contact provided in said cartridge when said cartridge is mounted to said mounting portion; and a main assembly guide configured and positioned to guide said cartridge to said mounting portion when said cartridge is mounted to said mounting portion;

said cartridge including:

process means for performing a process on an electrophotographic photosensitive member;

a cartridge electrical contact configured and positioned to supply electric power to said process means, said cartridge electrical contact being electrically connectable to said main assembly electrical contact when said cartridge is mounted to said mounting portion;

a first portion to be guided and a second portion to be guided configured and positioned to be guided by said main assembly guide to guide said cartridge to said mounting portion when said cartridge is mounted to said mounting portion; and a guide configured and positioned to guide said main assembly electrical contact to said cartridge electrical contact to establish an electrical connection between said main assembly electrical contact and said cartridge electrical contact when said cartridge is mounted to said mounting portion, wherein said guide and said cartridge electrical contact are is disposed between said first portion to be guided and said second portion to be guided, and said cartridge electrical contact is disposed upstream of said guide with respect to a direction in which said cartridge is mounted to said mounting portion.

14. A cartridge detachably mountable to a mounting portion provided in a main assembly of an electrophotographic image forming apparatus, said cartridge comprising:

a cartridge electrical contact configured and positioned to supply electric power to process means actable on an electrophotographic photosensitive member from the main assembly of the apparatus, said cartridge electrical contact being electrically connectable to a main assembly electrical contact provided in the main assembly of the apparatus when said cartridge is mounted to the mounting portion;

a first portion to be guided and a second portion to be guided configured and positioned to be guided by a main assembly guide provided in the main assembly of the apparatus to guide said cartridge to the mounting portion when said cartridge is mounted to the mounting portion; and a first guide and a second guide configured and positioned to guide the main assembly electrical contact to said cartridge electrical contact to establish an electrical connection between the main assembly electrical contact and said cartridge electrical contact when said cartridge is mounted to the mounting portion, wherein said first guide and second guide are disposed between said first portion to be guided and said second portion to be guided, and said cartridge electrical contact is disposed between said first guide and said second guide.

15. A cartridge according to claim 1, wherein said guide comprises first and second guides, wherein said cartridge has a recess, and wherein said first guide is a part of one end of an inner surface of the recess, and said second guide is a part of the other end of the inner surface of the recess.

16. A cartridge according to claim 3, wherein when said cartridge is mounted to the mounting portion, at least a part of the main assembly electrical contact passes through an inside of said recess.

17. A cartridge according to claim 4, wherein when said cartridge is mounted to the mounting portion, at least a part of the main assembly electrical contact passes through an inside of said recess.

18. A cartridge according to claim 15, wherein when said cartridge is mounted to the mounting portion, at least a part of the main assembly electrical contact passes through an inside of said recess.

19. A cartridge according to claim 9, wherein said guide comprises first and second guides, wherein said cartridge has a recess, and wherein said first guide is a part of one end of an inner surface of the recess, and said second guide is a part of the other end of the inner surface of the recess.

20. A cartridge according to claim 11, wherein when said cartridge is mounted to the mounting portion, at least a part of the main assembly electrical contact passes through an inside of said recess.

21. A cartridge according to claim 12, wherein when said cartridge is mounted to the mounting portion, at least a part of the main assembly electrical contact passes through an inside of said recess.

22. A cartridge according to claim 19, wherein when said cartridge is mounted to the mounting portion, at least a part of the main assembly electrical contact passes through an inside of said recess.

* * * * *

UNITED STATES PATENT AND TRADEMARK OFFICE

CERTIFICATE OF CORRECTION

PATENT NO. : 7,248,810 B2
APPLICATION NO. : 10/960055
DATED : July 24, 2007
INVENTOR(S) : Shigeo Miyabe et al.

It is certified that error appears in the above-identified patent and that said Letters Patent is hereby corrected as shown below:

COLUMN 1

Line 54, “electrical” should read --an electrical--.
Line 58, “contacts” should read --contacts,--.

COLUMN 3

Line 66, “apparatus 6” should read --apparatus 6a, 6b, 6c, and 6d--.

COLUMN 4

Line 17, “media 2,” should read --media S,--.
Line 50, “peripheral” should read --the peripheral--.

COLUMN 5

Line 30, “rotatable” should read --rotatably--.
Line 31, “bearings 31 (31a” should read --bearings 31a--.
Line 32, “31b)” should read --31b--.

COLUMN 6

Line 22, “hole” should read --holes--.
Line 53, “apparatus man” should read --apparatus main--.

COLUMN 7

Line 22, “of the their” should read --of their--.
Line 44, “disclosed” should read --be disclosed--.

COLUMN 8

Line 48, “end f” should read --end of--.
Line 58, “grooves 52a” should read --groove 52a--.
Line 63, “(3.0 mm)” should read --(˜3.0mm)--.

COLUMN 9

Line 52, “with a” should read --with--.

UNITED STATES PATENT AND TRADEMARK OFFICE

CERTIFICATE OF CORRECTION

PATENT NO. : 7,248,810 B2
APPLICATION NO. : 10/960055
DATED : July 24, 2007
INVENTOR(S) : Shigeo Miyabe et al.

It is certified that error appears in the above-identified patent and that said Letters Patent is hereby corrected as shown below:

COLUMN 11

Line 19, "widths b" should read --width b--.
Line 48, "lowing" should read --lowering--.

COLUMN 12

Line 54, "virtually" should read --a virtual--.

Signed and Sealed this

Sixth Day of January, 2009

JON W. DUDAS
*Director of the United States Patent and Trademark Office*